US009192808B2

(12) United States Patent
Stone

(10) Patent No.: US 9,192,808 B2
(45) Date of Patent: Nov. 24, 2015

(54) PORTABLE GYMNASTIC DEVICE

(76) Inventor: Peter Stone, Brooklyn, NY (US)

( * ) Notice: Subject to any disclaimer, the term of this patent is extended or adjusted under 35 U.S.C. 154(b) by 189 days.

(21) Appl. No.: 13/067,937

(22) Filed: Jul. 7, 2011

(65) Prior Publication Data

US 2013/0012360 A1 Jan. 10, 2013

(51) Int. Cl.

| | |
|---|---|
| ***A63B 21/16*** | (2006.01) |
| ***A63B 21/068*** | (2006.01) |
| ***A63B 21/00*** | (2006.01) |
| ***A63B 21/002*** | (2006.01) |
| ***A63B 23/12*** | (2006.01) |

(52) U.S. Cl.

CPC ..... *A63B 21/1636* (2013.01); *A63B 21/002* (2013.01); *A63B 21/068* (2013.01); *A63B 21/1469* (2013.01); *A63B 21/1484* (2013.01); *A63B 21/151* (2013.01); *A63B 21/1663* (2013.01); *A63B 23/1218* (2013.01)

(58) Field of Classification Search

CPC ..... A63B 27/00; A63B 21/002–21/0023; A63B 21/068; A63B 21/1469; A63B 21/1627–21/1663; A63B 23/1218; A63B 2023/0411; B25B 5/06; B25B 5/101–5/102; B25B 5/142; B25B 5/163

USPC ..... 482/23, 28–43, 92–96, 131, 904; 269/143, 249, 254 CS; 29/257, 276; 16/443–444; 81/91.3, 97, 99

See application file for complete search history.

(56) References Cited

U.S. PATENT DOCUMENTS

| | | | | |
|---|---|---|---|---|
| 864,188 | A * | 8/1907 | Patterson | 482/96 |
| 3,441,147 | A * | 4/1969 | Kelley | 211/113 |
| 3,716,232 | A * | 2/1973 | Johnson et al. | 482/40 |
| 4,258,895 | A * | 3/1981 | Rorie | 248/544 |
| 5,429,571 | A * | 7/1995 | Smith et al. | 482/115 |
| 5,947,875 | A * | 9/1999 | Cone et al. | 482/69 |
| 6,705,974 | B1 * | 3/2004 | Tardif | 482/39 |

* cited by examiner

*Primary Examiner* — Oren Ginsberg
*Assistant Examiner* — Jennifer M Deichl

(57) ABSTRACT

A portable gymnastic device comprising a suspension means having two opposed and complementary rigid hooks, which are pivotally connected together and to a U-shaped frame by a pin. Hooked upper ends of the hooks are engaged over a horizontal cross member of the doorframe or a horizontal bar. The hooks are normally biased to a closed position permanently by the spring. A rope is connected with the U-shaped frame by a knot, which is placed on a top end of the rope. A handle is connected with a bottom end of the rope by suitable means such as a cam within the handle. On the bottom end of the rope several handles may be set on different levels to accommodate different height users and different exercises.

13 Claims, 10 Drawing Sheets

14
29'
29
13
13
22
22'
22
2b
91'
91
25(25')
27
21
28'
28
24'
24
23
31
42
41
35
43
44
51
52
45a
2b

33(33')
34'
34
31
32
35

22
25
24

28
33(33')
25(25')
23
27
24(24')
42
32
35
43
44
45d
51
l
45c
45b
52
r
45k
45i
45j
45e
45f
45g
45h

Fig. 11
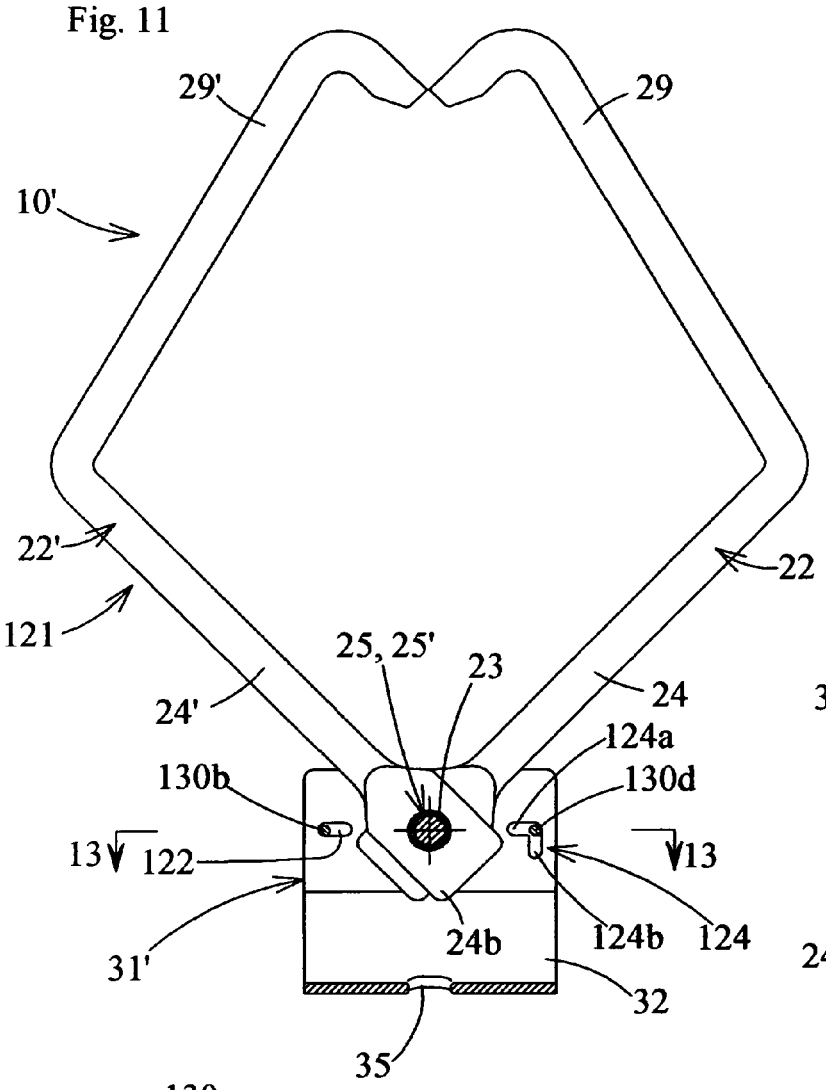
Fig. 12
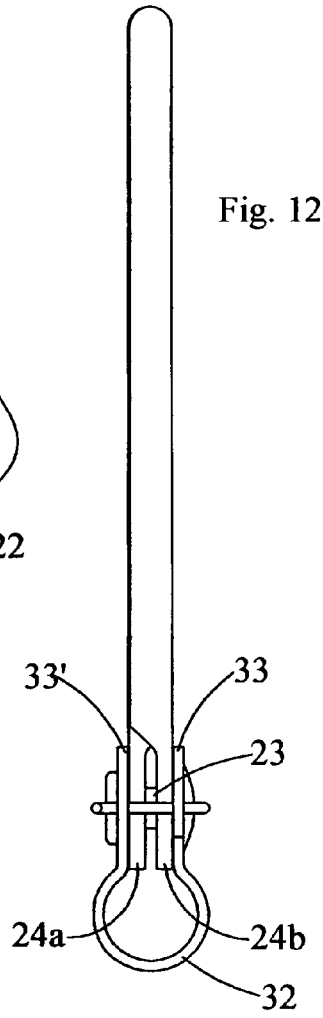
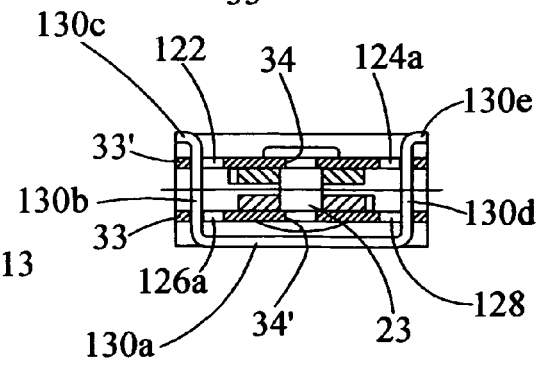
Fig. 13
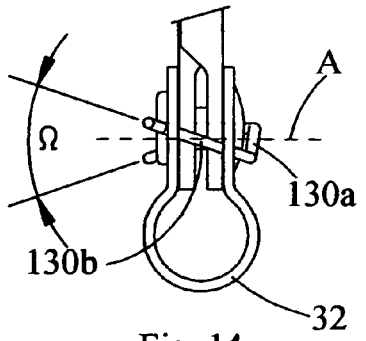
Fig. 14

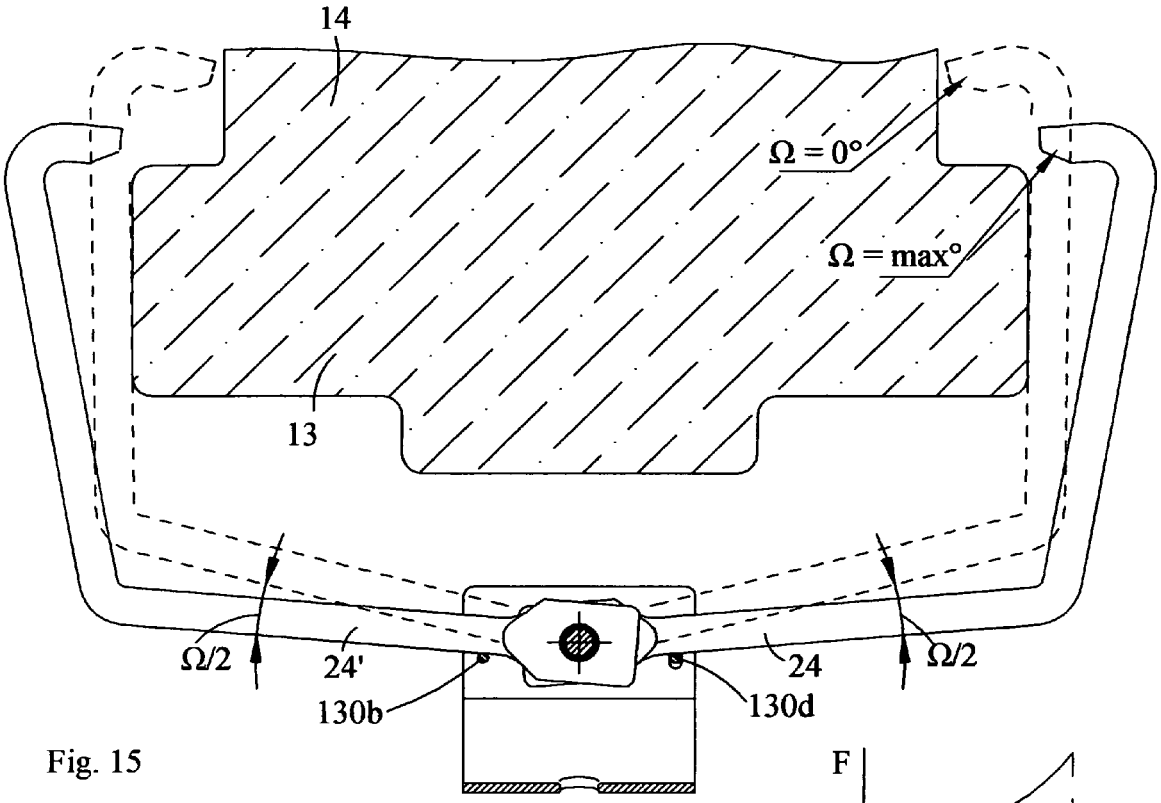
Fig. 15
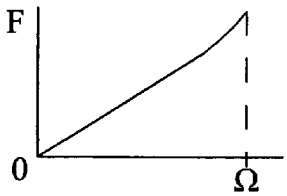
Fig. 22
Fig. 16
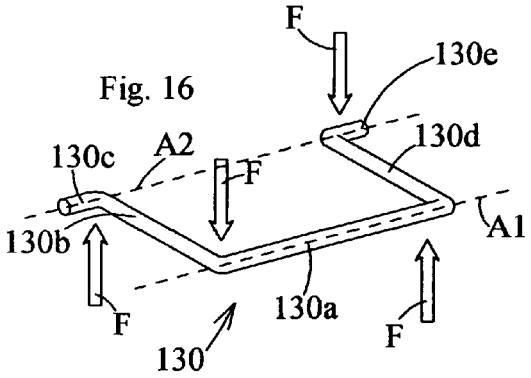
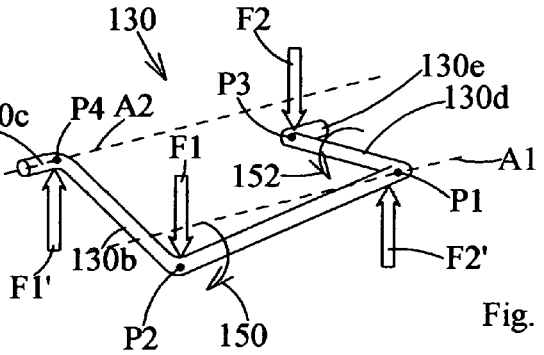
Fig. 19

PORTABLE GYMNASTIC DEVICE

BACKGROUND OF THE INVENTION

1. Field of the Invention

The present invention generally relates to training and exercise devices, and, more specifically, to a portable gymnastic exercise device that can be quickly and easily set up on and then removed from any door casing or frame or other support structure or member.

2. Description of the Prior Art

The use of pincer mechanisms for suspending different items from an overhead member, such as a casing or frame of a doorway within a wall, is well known. Pincers are generally devices that utilize complementary hooks that are pivoted to each other to urge inwardly-directed hooks or Jaws towards each other in response to a downward force acting on the pincer, as exemplified in U.S. Pat. No. 4,258,895.

Pincer type mechanisms have also been utilized to suspend numerous other items such as swings for infants or children, as disclosed in U.S. Pat. Nos. 1,956,502 and 3,314,636. While most pincer mechanisms close to apply pressure to the supporting member as a result of a downwardly acting force some pincer mechanisms use some form of biasing means, such as a tension spring, to tend to close or bring the opposing hooks together even in the absence of a downwardly acting force on the device. The aforementioned U.S. Pat. No. 3,314,636 teaches the use of such a tension spring. A similar pincer mechanism is disclosed in U.S. Pat. No. 3,441,147 for hanging garments on a rod that is suspended by using a pair of spaced or opposing pincer devices.

U.S. Pat. No. 7,381,173 discloses a training apparatus that uses a pair of opposing brackets that function as hooks, although the disclosed attaching mechanism does not include pincers. The brackets are used to support a horizontal member to which an exercise device, such as a handle loop, is attached. A cleatlock is used to adjust the height of the handle loops. However, the training apparatus includes a number of parts that must be manually adjusted to secure it to a doorframe. Besides the inconvenience of attaching and disconnecting the device from the supporting structure, improper adjustments can result in failure by inadvertent disconnection of the brackets from the supporting frame and potential injury to the user.

Numerous training devices use pincer-type clamping elements, each including a pair of hooks pivoted to each other that can be engaged over a casing by hooked upper ends, are well known. As indicated, such pincer devices frequently use springs or the like to urge the hooks to come together to a closed condition so that the pincers securely engage and remain attached to an upper frame or support member, including a horizontal bar.

An early portable gymnastic apparatus is disclosed in U.S. Pat. No. 1,126,857 in which a hook is attachable to a casing of a doorframe, the hooks supporting a training bar and/or a pair of spaced handgrips. The device, however, includes numerous parts and needs significant manual adjustments to properly secure the device to a support member, such as a doorframe. Since only one hook is used adjustments and setup is more critical and subject to failure.

In U.S. Pat. No. 3,716,232 an exercise apparatus for attachment to an overhead frame is disclosed. While the pincer mechanisms are used the pincers support a rod. Also, since no biasing members are provided setup and adjustment must be performed manually by means of set screws. The setup, therefore, may be inconvenient and time-consuming. Because bars are utilize, the overall structure is bulky and heavy and not readily transported from one location to another. A similar clamping apparatus is disclosed in U.S. Pat. No. 2,206,328 intended to be used for exercise bars, swings or the like in the doorway. As in the aforementioned device, the pincers must be manually adjusted, leaving room for human error and failure.

An elaborate construction is used for an exercise device disclosed in U.S. Pat. No. 1,430,573 in which the hooks are pressed against the supporting frame by means of a yoke and screw mechanism to support a rod. The device is bulky and heavy and not readily transportable. A similar clamping device is disclosed in U.S. Pat. No. 3,526,399 for supporting a rotatably mounted exercising device with support frames.

In U.S. Pat. No. 5,429,571 a personal trainer is disclosed that utilizes a pincer mechanism for engaging the doorframe and a resistance unit is provided intended to be gripped by a user by means of a horizontal bar or handle. The resistance unit provides resistance as the handle is moved upwardly and downwardly on a belt while the user tensions the device by stepping on a stirrup close to the ground. The device is intended to be primarily used while the person exercising stands erect, although the patent also teaches a way for the user to exercise the stomach muscles while in a kneeling position.

The known exercise devices tend to be large, bulky and heavy and are typically complicated in construction and expensive to manufacture and purchase. They are not readily transportable and can be effectively used only by a very limited segment of the population who are heavily into exercise. The average person needs a device that can be easily transported and used even by those that have limited physical strength or who are physically challenged.

SUMMARY OF THE INVENTION

It is, accordingly, an object of the present invention to provide a portable gymnastic device that can be carried in a pocket or handbag to work from home to allow anyone to use the device not only in one location but at multiple locations, such as the home and the workplace, whenever they have the time or inclination to exercise.

It is a primary object of the invention to provide a portable and lightweight gymnastic device that can be used by people that may have weak upper or lower bodies, namely arms and/or legs strength, by allowing the user to allocate energy between the weaker and stronger muscle groups and combine the energies from such muscle groups to compensate as needed by the stronger muscle groups for the weaker muscle groups to allow the person to conduct exercises which otherwise could not be performed if the user only relied on one of the muscle groups as with most exercise devices.

It is another object of the invention to provide a portable gymnastic device that can be used by anyone, including children, without changing or modifying the device.

It is still another object of the invention to provide a portable gymnastic device that is easy and convenient to use.

It is yet another object of the invention to provide a portable gymnastic device that is simple in construction and economical to manufacture.

It is an additional object of the invention to provide a portable gymnastic device that includes handles or grips that can be easily, quickly and reliably adjusted to accommodate users of different heights and to adapt the device for different forms of exercise.

In order to achieve the above and other objects a portable gymnastic device in accordance with the invention includes suspension means in the form of a pincer mechanism having two opposed and complementary rigid hooks that are pivotably connected to each other and suitable for engaging a casing or horizontal bar by the hooked upper ends of the hooks. A spring is used to bias the hooks together towards a closed condition. A U-shaped frame pivotally supports the hooks and depending line or rope, handles being connected to the rope at a height suitable for gripping to allow a person's body to be pulled upwardly by the arms while at the same time providing a pushing action by the legs, the arms and the legs cooperating and providing measured forces as needed to provide the total force for supporting, lowering and raising the body with the arms holding the handles of the device, to thereby compensate with the stronger muscle group(s) to make up and compensate for the weaker muscle group(s).

BRIEF DESCRIPTION OF THE DRAWINGS

The invention, together with further aspects, features and advantages thereof will be more clearly understood by considering the following description in conjunction with the accompanying drawings in which like elements bear the same reference numerals throughout the several views.

FIG. 11 is similar to FIG. 2*a*, partly in cross-section, but showing a modified spring arrangement for the suspension device that is contained within the U-shaped frame;

FIG. 12 is a side elevational view of the suspension device shown in FIG. 11;

FIG. 13 is a cross-sectional view of the device shown in FIG. 11, taken along line 13-13;

FIG. 14 is a fragmented section of the device shown in FIG. 12, illustrating the deflection of the torsion spring when deflected by the hooks of the device beyond a predetermined separation there between;

FIG. 15 is similar to FIG. 11, showing the device about to be mounted on a doorframe and showing the hooks in the extreme extended or separated positions to deflect the biasing torsion spring and, in dash outline, the door frame-engaging positions to which the hooks are urged to move by the torsion spring;

FIG. 16 is a perspective view of the torsion spring used in the device shown in FIGS. 11-15 in the relaxed condition and the locations and directions of the forces that are applied to the spring when the hooks are separated to the position as shown in solid outline in FIG. 15;

FIG. 19 is similar to FIG. 16 but showing the spring in a distorted or tensioned state in response to application of the forces shown in FIG. 16 to the various pressure points of the spring to which the forces are applied;

FIG. 22 is a force diagram showing the relationship between the forces applied to the various pressure points on the torsion spring and the extent of deflections of the legs or segments of the torsion spring.

DETAILED DESCRIPTION OF THE PREFERRED EMBODIMENTS

Figure 1A:
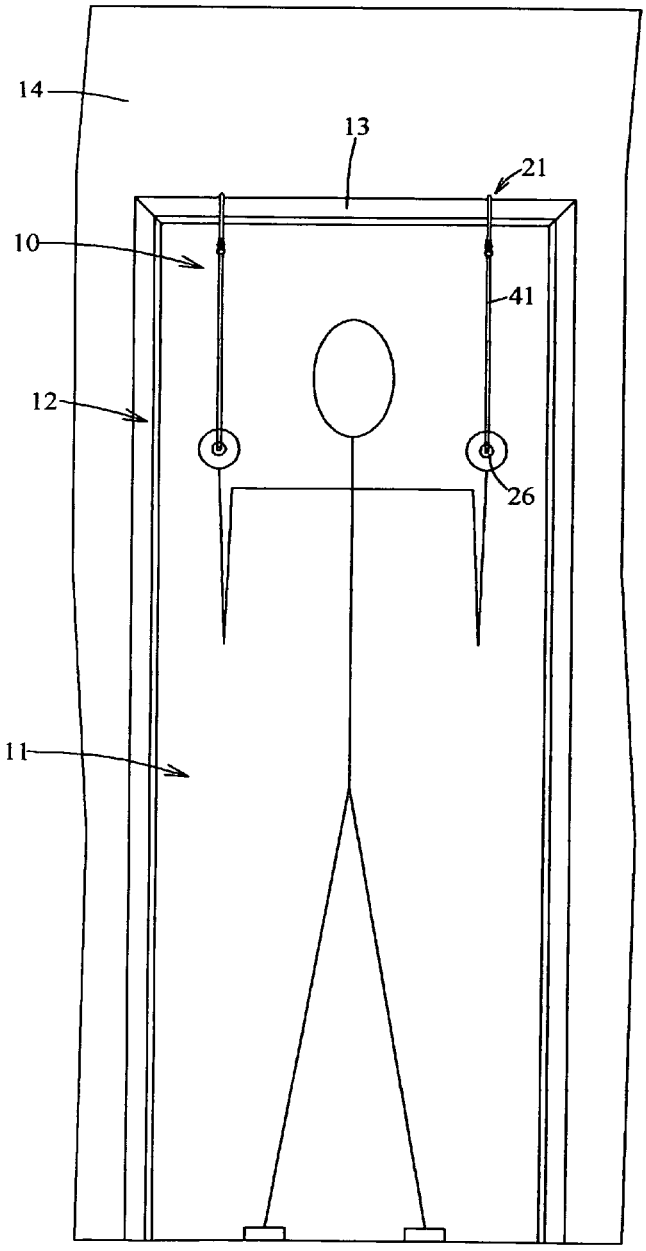
FIGS. 1*a* and 1*b* are front and side elevational views, the latter in cross-section along line 1*b*-1*b* in FIG. 1*a* of a portable gymnastic device according to the invention attached to a conventional doorway frame and a person, schematically, exercising therewith.

Referring now to the drawings in detail, in which identical or similar parts will be designated by the same reference numerals throughout, and first referring to FIGS. 1-4, two like portable gymnastic devices are generally designated by the reference 10, shown installed within an opening 11 of a doorframe 12 in a wall 14. The devices 10 are supported on a frame 13 by means of suspension means 21.

Figures 2A, 2B, 3, 4:
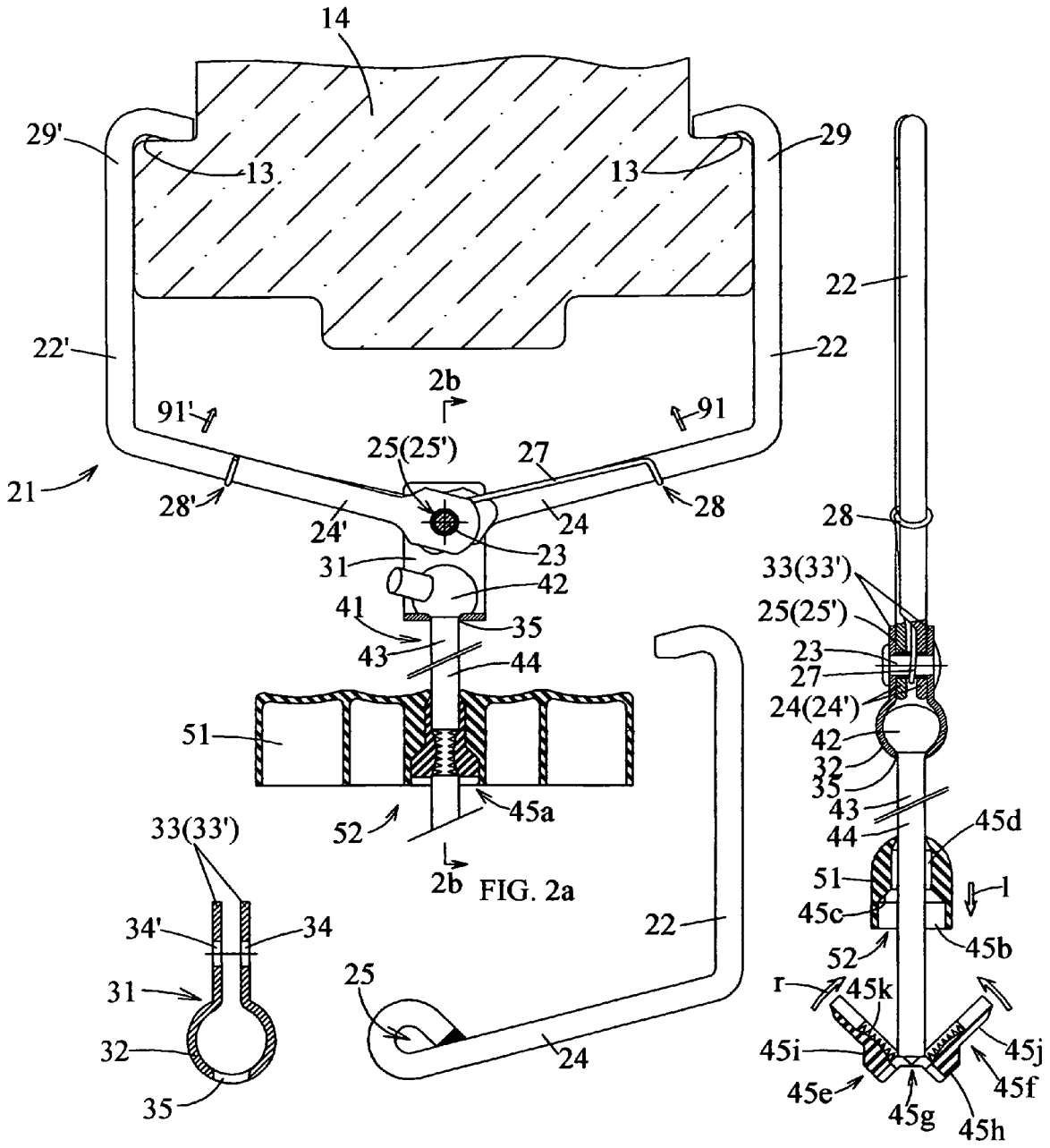
FIGS. 2*a* and 2*b* are enlarged views, partly in cross-section, of the front and side views of the portable gymnastic device according to the invention using a torsion spring and illustrating a handle cord lock in the form of a clamp in the line locking and releasing positions, respectively.
FIG. 3 is a cross-sectional view of the U-shaped frame shown in FIGS. 2*a*, 2*b;*
FIG. 4 is a side elevation view of a modified shape of the hook.

The suspension means 21 includes two opposed and complementary rigid hooks 22 and 22', that are pivotably supported on a U-shaped frame 31 by means of a pin 23. Lower ends 24, 24' of the hooks 22 and 22' have holes 25 and 25' to engage with a pin 23. The hooks 22, 22' are engaged by hooks 28 and 28' of a torsion spring 27 to normally bias the hooks 22, 22' to move towards each other to a closed position as shown in FIG. 2*a* by arrows at 91 and 91'. The hooked upper ends 29 and 29' of the hooks 22, 22' are engaged with and supported by a horizontal cross-member 13 of the doorframe 12.

As shown in FIG. 3, the U-shaped frame has two flat members to 33 and 33' with holes 34 and 34' to connect with a lower ends 24 and 24' of the hooks 22 and 22' by the pin 23. As shown in FIG. 2*b* the lower ends 24 and 24' of the hooks 22 and 22' have a flat shape and are placed between the flat members 33 and 33'. The torsion spring 27 is placed between the lower ends 24 and 24' and the pin 23 is connected to all of them.

A cylindrical member 32 of the U-shaped frame 31 has a hole 35 as shown (FIG. 3) to connect with a line or a rope 41. Depending on the size of the hooks 22, 22' and the diameter of the rope 41 the shape of the cylindrical member 32 can be changed to accommodate the rope. The rope 41 is formed with a knot 42 at its upper end 43 after it is passed through the hole 35 of the U-shaped frame 31 and having dimensions greater than the hole to prevent the rope from separating from the U-shaped frame 31. The knot 42 is placed inside of the cylindrical member 32 of the U-shaped frame 31. At the bottom end 44 of the rope 41 there is also formed with one or more knots 45, 45', 45" (FIG. 5*a*) that that maintain the handles 51, 51', 51" at desired positions or heights, the handles having a hole 52 dimensioned to allow passage of the rope but not the knot(s).

A presently preferred construction for securing the handles to the ropes is illustrated in FIGS. 2*a*, 2*b* that not only allows easy and secure attachments of the handles to the ropes but also allows easy adjustments to facilitate quick and reliable movements of the handles along the ropes and fixing their relative positions to desired heights of the handles to accommodate different users and exercises. The handles are provided with a central line or rope passageway or channel 45*a* formed of a lower larger cylindrical cavity 45*b*, a tapered portion 45*c* and an upper smaller diameter channel 45*d*, all of these being arranged along an axis of symmetry generally normal to the width direction of the handle. A pressure-activated clamp 45*e* is formed of a pair of alligator type jaws 45*f* are joined together along a plastic hinge 45*g* as shown in FIG. 2*b*. The hinge 45*g* has a central hole to accommodate passage of the rope 41 as shown in FIG. 2*a*. Each jaw 45*f* includes a lower larger diameter portion 45*h*, a taper 45*i*, an upper lower diameter portion 45*j* and inwardly-directed spikes or teeth 45*k*.

Referring to FIGS. 2*a* and 2*b*, to adjust the handle to any vertical position on the line or rope the clamp 45*e* is opened to separate the jaws 45*f* by pivoting about the hinge 45*g*. The handle, with the rope extending through the hole as shown in FIG. 2*b* can be freely slid up or down relative to the rope. When a suitable position has been reached the jaws 45*f* pivoted towards each other about the hinge 45*g* as suggested by the arrows "r" until the spikes penetrate the rope and the jaws are forced to compress the rope. The handle 51 is then moved to engage the clamp 45*e* as suggested by the arrow "1" until the jaws 45*f* are received within the opening 45*a* in the handle. In doing so the external surfaces on the clamp 45*e* mate with the associated internal surfaces of the opening 45*a* and the dimensions are preferably selected to provide a press fit when the clamp is fully received within the opening to insure that the spikes 45*k* continue to penetrate the rope and prevent slippage one relative to the other and that the handle and clamp do not inadvertently separate, as shown in FIG. 2*a*.

A preferred level for the handle 51 is a level corresponding to the height of the chin of the user, with a person exercising normally standing on the floor. As shown in FIG. 4, the hole 25 of the hook 22 can be made by bending and welding the lower end 24 of the hook 22.

Preferably, the material for the hooks 22, 22' has a diameter 0.25 inches and formed of music wire with nickel plating and having a hardness of 44-48 steel.

Figure 5A:
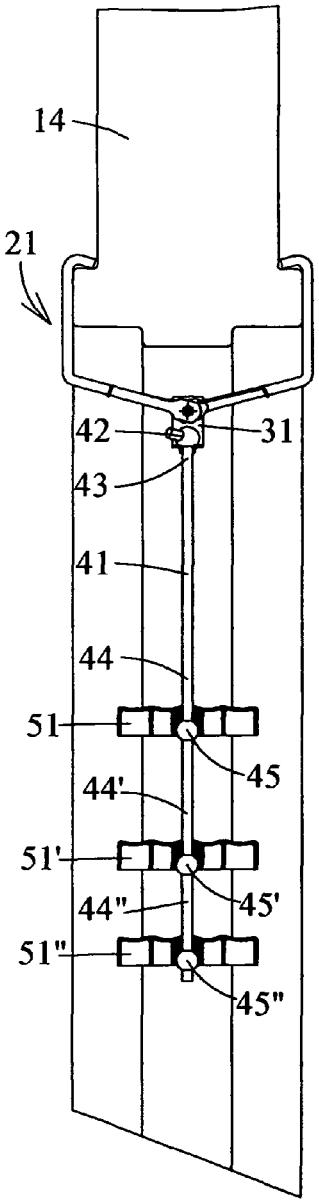
FIG. 5*a* is a side elevational view of a portable gymnastic device according to the invention with several handles attached to the end of the rope.
Figure 5B:
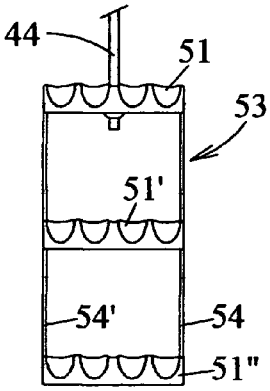
FIG. 5*b* is a side elevational view of modified multi-level handles.

As shown in FIG. 5*a* several exercising people having different heights can use the same device without changing the device. Typically, different family members or co-workers could use the device by sharing a single device. In that case, the device consists of several handles installed at different levels as shown. The handles 51, 51', 51" are secured by knots 45, 45', 45" on the ends of 44, 44, 44" of the rope 41 and installed according to the heights of the people anticipating using the device. For this application of the portable gymnastic device the handle means is a handle-ladder 53, which is formed from several handles connected together by means of slats 54 and 54' as shown in FIG. 5*b*.

Figure 6:
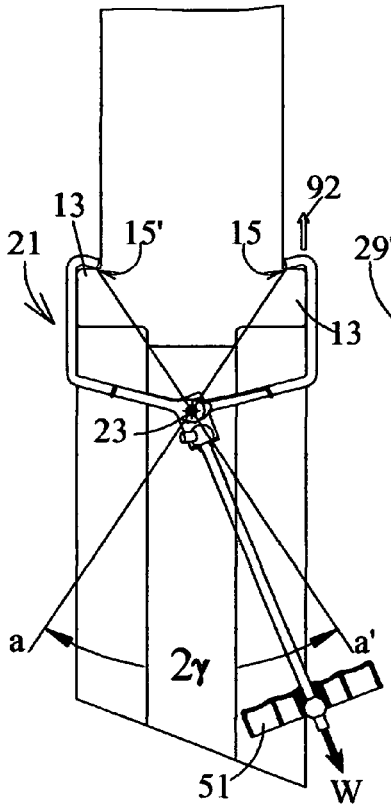
FIG. 6 is a fragmented view of a portable gymnastic device according to the invention showing an angle of deviation of the handles from the vertical during exercise.
Figure 7:
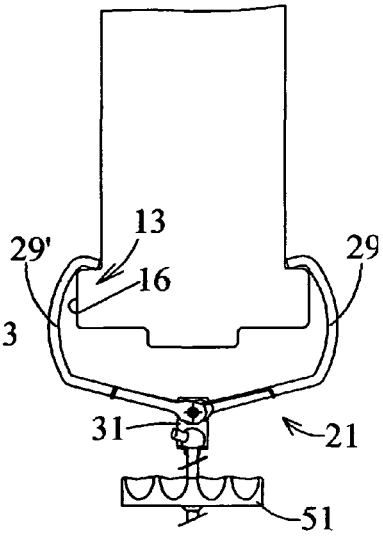
FIG. 7 is a view similar to FIG. 2*a* but illustrating another modified shape of the hooks.

Angle limit deviation $\gamma$ of the handle 51 from the vertical position (FIG. 6) is determined as an angle between the vertical line and lines "a" extending from the pin 23 and points 15, 15', which are contact points of the hooks 22, 22' with a ledge or lip of the horizontal cross-member 13 of the doorframe 12. If the deviation is less than gamma the weight W. of the exercising person is distributed to both hooks 22 and 22'. If a the deviation is greater than $\gamma$ all the weight W goes through one hook and the other starts to move upwardly above the ledge as suggested in FIG. 6 to by arrow 92. Preferably, $\gamma \approx 35°$. It is best to use the portable gymnastic devices without any deviation beyond the recommended angle or lifting of either of the hooks. To avoid any mechanical contact between a face surface 16 of the horizontal cross-member 13 of the doorframe 12 the hooks 22, 22' upper ends 29, 29' of the hooks can be bent or bowed outwardly as shown in FIG. 7.

Figure 8:
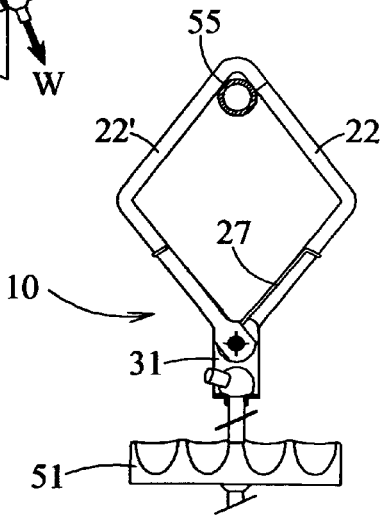
FIG. 8 is a side view of a portable gymnastic device according to the invention attached to a horizontal bar.

As shown in FIG. 8, the portable gymnastic devices 10 can also be used with a regular horizontal bar 55 as well. The hooks 22, 22' will join or overlap by the torsion spring 27 to ensure a positive contact and connection to the bar without risk of inadvertent separation from the bar. A significant percentage of average people do not have sufficient strength in their upper body or in their arms to pull themselves up or chin up a horizontal bar, or to do squats without any assistance. However, with the help of the present invention, both of these exercises, that are important for the health of the joints and muscles, are easily achieved by anyone regardless of their health conditions or ages.

Figure 1B:
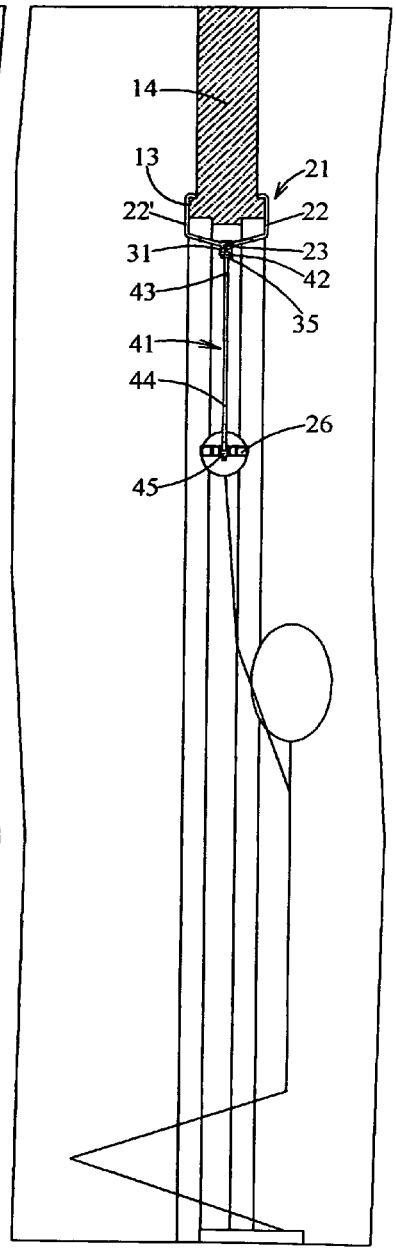

In FIGS. 1*a* and 1*b* upper and lower positions of an exercising person is shown. To move between these two positions a person can distribute their own weight between their arms and their legs according to their abilities. Compared with a regular exercise device such as a horizontal bar, to do chin-ups is more difficult to use the bar because the user must pull up the entire weight of the body by pulling up with the arms. Significant strength in the arms and upper torso are needed to achieve this exercise. Because of the construction of the device in accordance with the present invention the user can redistribute the stresses between the arms, upper body and the legs, so that they can all contribute to performing the exercise desired by the user with the relative stresses of forces applied by the muscles being selected and controlled by the user.

The exercise device in accordance with the invention is convenient to use and is available at any time that exercise is desired. Because of the smaller size and weight of the device it is possible to hide and transport the device and prepare it for exercise in a matter of seconds in any room of the house or apartment or in an office. The device is extremely transportable, fitting into a pocket or a handbag or pocketbook. It is a very valuable device for people who have physical limitations and yet want to stay in good shape.

Figure 9A:
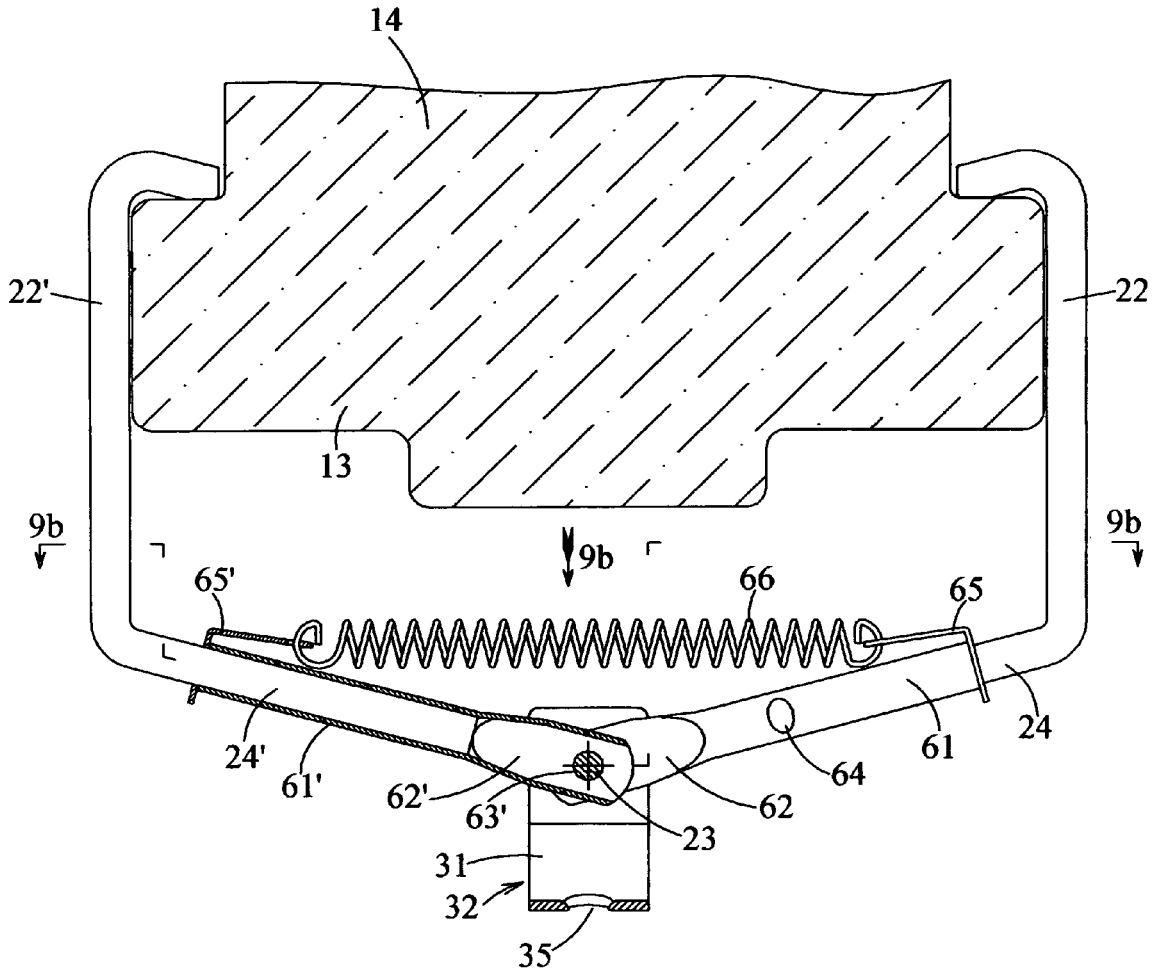
FIG. 9*a* is an enlarged a fragmented front view of a portable gymnastic device according to the invention with a tension spring.
Figure 9B:
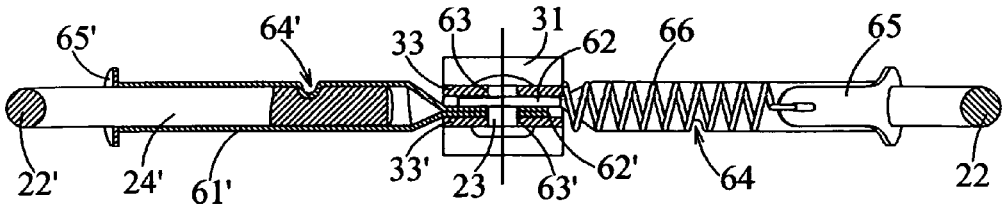
FIG. 9*b* is a cross-sectional view of the devices shown in FIG. 9*a* taken along line 9*b*-9*b;*
Figure 10A:
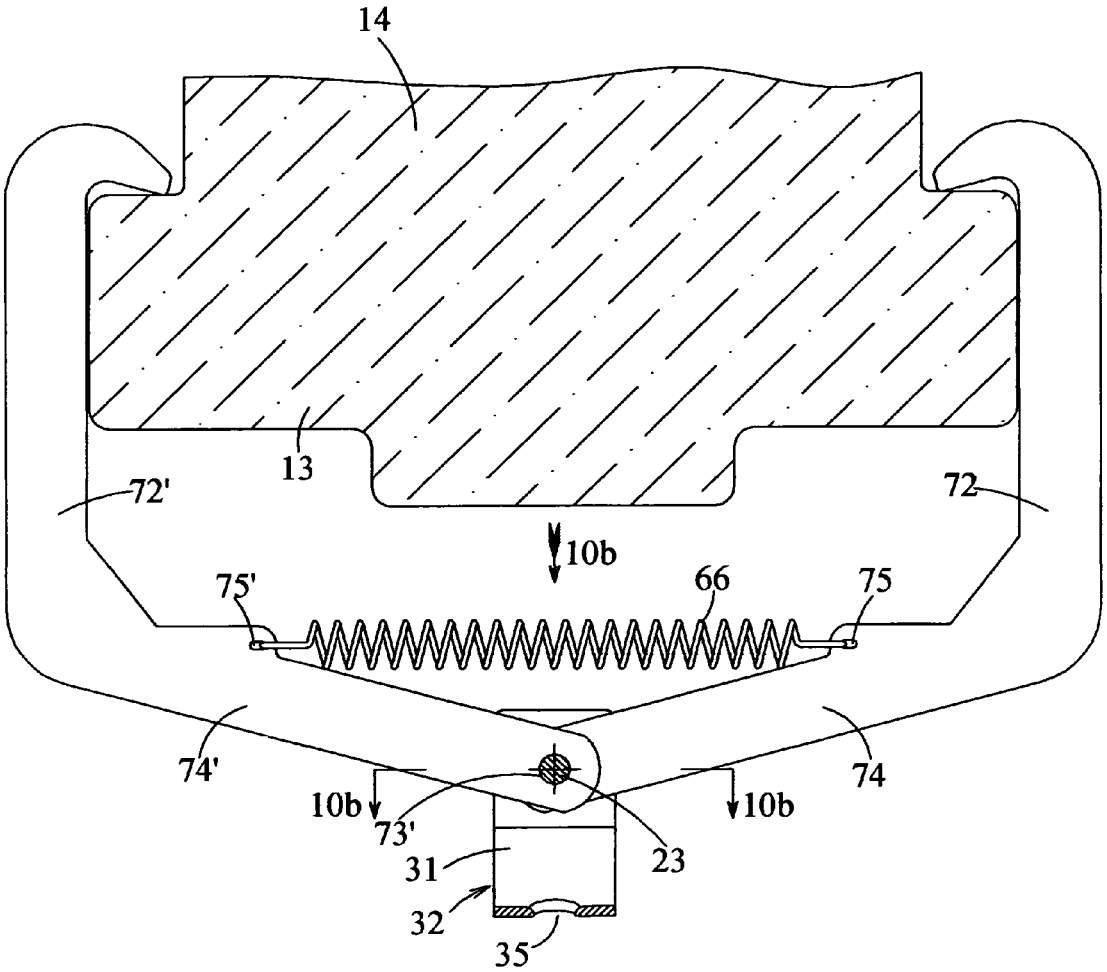
FIG. 10*a* is a view similar to FIG. 9*a* with modified hooks formed of sheet material formed by stamping.
Figure 10B:
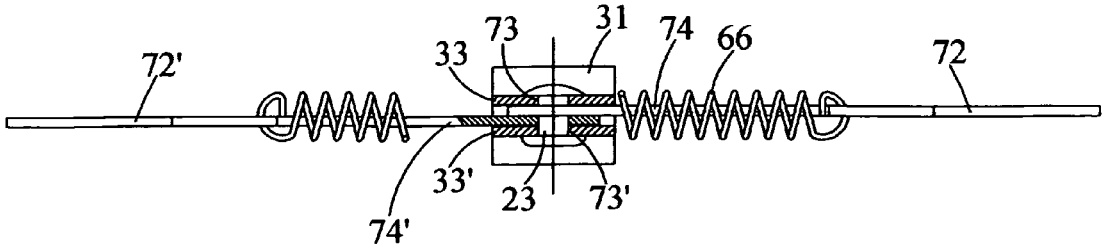
FIG. 10*b* is a cross-sectional view of the device shown in FIG. 10*a*, taken along line 10*b*-10*b;*

In FIGS. 9 and 10 two modifications of the portable gymnastic device are shown. In FIG. 9 the lower ends 24, 24' of the hooks 22, 22' to not have any holes. Instead of this is a hooks 22, 22' are in the form of tubes is 61, 61', one end of each tube 62, 62' having flattened ends provided with a hole. To hold the hook 22 and the tube 61 together the end 24 of the hook 22 has a cavity 64 which is filled by a tube 61 metal by stamping. The holes 63, 63' are used to connect two hooks 22, 22' together and to the U-shaped frame 31 by the pin 23. Washers 65, 65' and a tension spring 66 are installed on the hooks 22, 22' before the tubes is 61, and 61' are connected with the hooks 22, 22' by stamping. And FIG. 10 the portable gymnastic device with stamped hooks 72, 72' and the extension spring 66 is shown. Lower ends 74, 74' have holes 73, 73' to engage with the pin 23. The hooks of 72, 72' have holes 75, 75' to be connected with the extension spring 66.

Referring to FIGS. 11-22 another embodiment 10' is illustrated in which the spring or biasing member is fully enclosed and concealed within the U-shaped frame 31'. The device 10' generally operates in the same way as the previously described embodiments except that the helical and compression springs are replaced with a torsion spring that makes it possible to mount the spring within the U-shaped frame.

Figure 21:
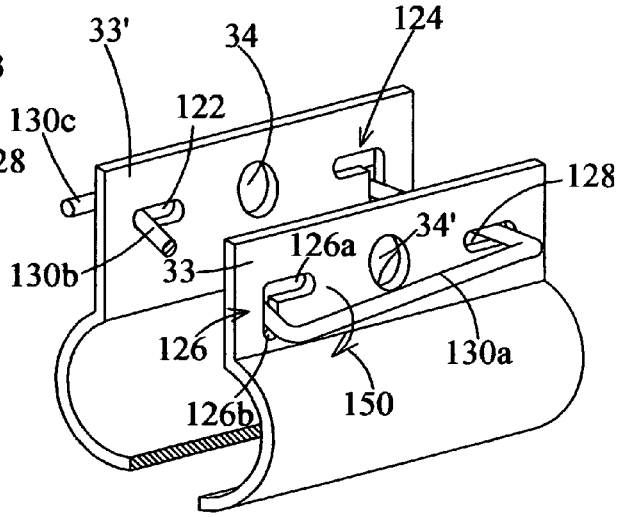
FIG. 21 is similar to FIG. 18 with the spring shown in the deflected state.

The suspension member 121 may include the same hooks 22, 22', with the lower flat portions 24*a*, 24*b* secured between the flat members 33, 33' of the U-shaped frame. However, each of the flat members 33, 33' are provided with a series of horizontal and L-shaped slots, openings or apertures 122, 124, 126 in 128, with a generally straight horizontal slot 122 and L-shaped slot 124 being provided on the flat members 33', as shown, and generally straight horizontal slot 128 and L-shaped slot 126 being provided on the flat members 33 as shown. It will be noted that at each lateral or extreme end of the opposing flat members a generally straight horizontal slot faces an opposite L-shaped slot. All of the horizontal portions of all of the slots are generally arranged in a substantially horizontal plane while the downwardly extending vertical portions of the slots 124*b* and 126*b* extend from that horizontal plane. This is best shown in FIGS. 18 and 21.

The spring used in connection with this modified U-shaped frame is a torsion spring best shown in FIGS. 16 and 19 and designated by the reference numeral 130. The torsion spring 130 is preferably formed of spring or piano wire or any other suitable material commonly used for torsion springs, and is generally U-shaped as shown. Thus, the spring 130 has an elongate portion 130*a* defining and axis A1 (FIG. 19) and normal leg portions 130*b* and a 130*d* generally perpendicular to the axis A1. The leg portions 130*b* and 130*d* each has a free end that extends in opposite directions along a common axis A2 as shown. The length "D" of the elongate portion 130*a* is not critical but in the illustrated embodiment is approximately 1.25 in. while the lengths "d" of each of the leg portions 130*b* and 130*d* is approximately ⅝ in. which must correspond to be compatible with the spacings and dimensions of the slots, openings or apertures 122, 124, 126 and 128 as will become apparent from the description that follows.

As best as shown in FIGS. 11 and 13, the spring 130 is first inserted through the various slots or openings 122, 124, 126 in 128 for the hooks to be attached to the U-shaped frame while the hooks 22, 22' are in the fully retracted conditions as shown in FIG. 11. In these conditions, the slots 122, 124, 126 and 128 are readily accessible so that the spring 130 can be inserted by moving the free ends 130*c* and 130*e* through the slots 126 and 128, respectively. This requires that the spring 130 be temporarily deformed by squeezing the leg portions or segments 130*b* and 130*d* towards each other to allow the deflected ends 130*c* and 130*e* to clear that apertures or slots 126 and 128. The free ends 130*c* and 130*e* are subsequently similarly inserted through the slots 122 and 124 by likewise squeezing or urging the leg portions of segments 130*b* and 130*d* towards each other so that the ends 130*c* and 130*e* likewise clear the slots or apertures 122 and 124, respectively. It will be appreciated that the once the spring 130 has been inserted through the slots or apertures, as described, it remains captured and cannot inadvertently separate from the U-shaped frame as a result of the interference fit between the deflected free ends 130*c* and 130*e* as shown in FIGS. 13 and 17-21.

Figure 17:
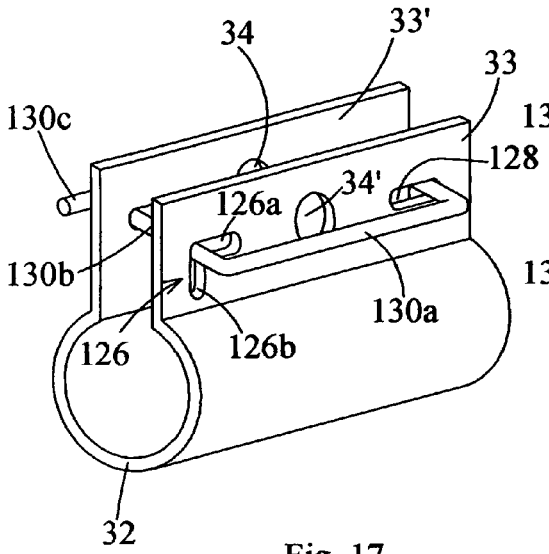
FIG. 17 is a perspective view of the U-shaped frame used in the device shown in FIGS. 11-15, showing the torsion spring mounted on the flat members of the U-shaped frame and in the relaxed condition of the spring.
Figure 18:
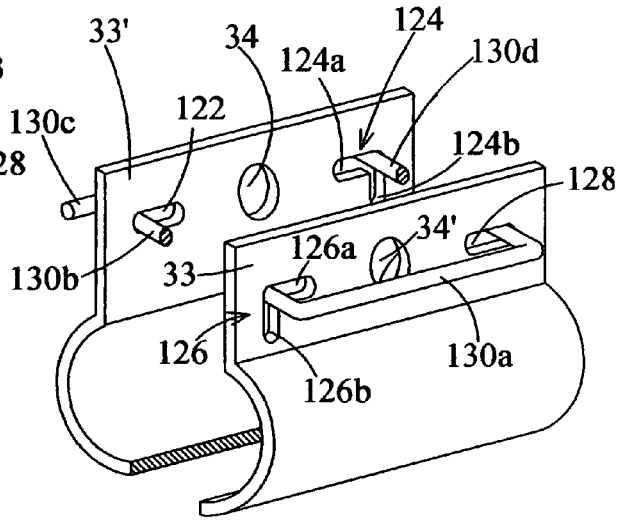
FIG. 18 is similar to FIG. 17 but with the U-shaped frame cut along a vertical plane of symmetry and the sections separated to show the details of the holes or apertures or slots within the flat members of the frame and the positions of the various portions or segments of the torsion spring while in the relaxed condition.
Figure 20:
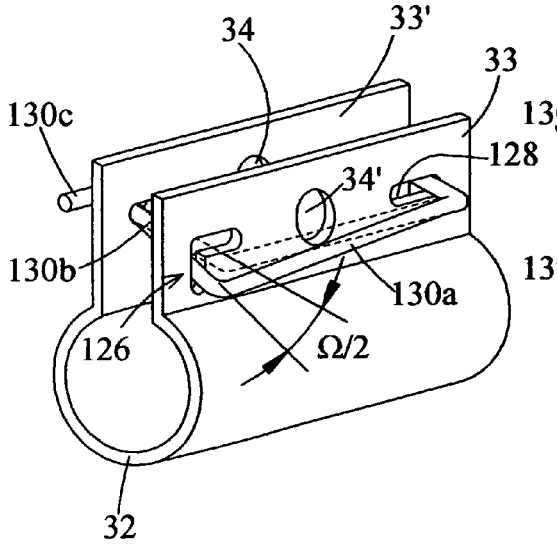
FIG. 20 is similar to FIG. 17 but showing the torsion spring in the deflected or tensioned state in response to the separation of the hooks to the extreme positions as shown in a solid outline in FIG. 15.

In the contracted positions of the hooks 22, 22' there is no contact between the hooks and the torsion spring 130, as shown in FIG. 11, and the spring is in its relaxed state in a substantially horizontal plane as shown in FIGS. 12, 17 and 18. When the hooks 22, 22' are separated to the extreme extended positions shown in FIG. 15, in order to clear the frame 13 the lower ends 24, 24' engage respective leg portions 130*d* and 130*b*, respectively, and tend to move the leg portions a downwardly below the plane in which the torsion spring is generally arranged when relaxed. As best shown in FIGS. 17-21, however, the slot 128 is horizontal and does not permit the spring at P1 to move downwardly. The same is true for point P4. However, as a result of the downwardly-oriented slot portions 124*b* and 126*b* the spring pressure points P3 and P2 are permitted to move below the plane of the relaxed spring as best shown in FIGS. 14, 20 and 21. Since point P4 and point P1 remain fixed the leg portions 130*b* and 130*d* experience movements 150 in a clockwise direction (FIG. 19) and counterclockwise movement 152 as shown. These opposing movements of the leg portions 130*b* and 130*d* create a torsional deformation in the spring portion or segment 130*a* that tends to reverse the rotational movements of the leg portions into the plane of relaxation. Therefore, when the hooks 22, 22' are extended to the positions as shown in a solid outline in FIG. 15, to engage with the leg portions 130*b* and 130*d* the torsion spring 130 biases the hooks 22, 22' to move closer together as shown in phantom outline to ensure that the hooks securely engage the frame as described.

FIG. 22 illustrates the force F as a function of deflection of the leg portions 130*b* and 130*d*. With the total deflection Ω between the two leg portions (FIG. 14) each of the leg portions has been deflected an angle Ω/2 above and below the plane of the relaxed spring, respectively, this angle also corresponding to the degree of movement of each of the lower ends 24, 24', as best shown in FIG. 15. Clearly, the greater the angle Ω the greater the force F that needs to be applied to torsion spring to deflect it and the greater the restoring force, as shown in FIG. 22. The forces F1, F1' are equal as are the forces F2, F2'. The purpose of the torsion spring 130, then, is to ensure that the hooks to do not inadvertently slip off of the frame 13 but move the hooks into engagement with the frame until such time that a downward force is applied on the U-shaped frame after which point the hooks move further together and embrace the frame of the door and prevents inadvertent separation. As will be appreciated, the embodiment 10' exposes only minor portions of the spring and totally conceals the interaction between the spring of the lower ends 24, 24' of the hooks 22, 22'.

Figure 23:
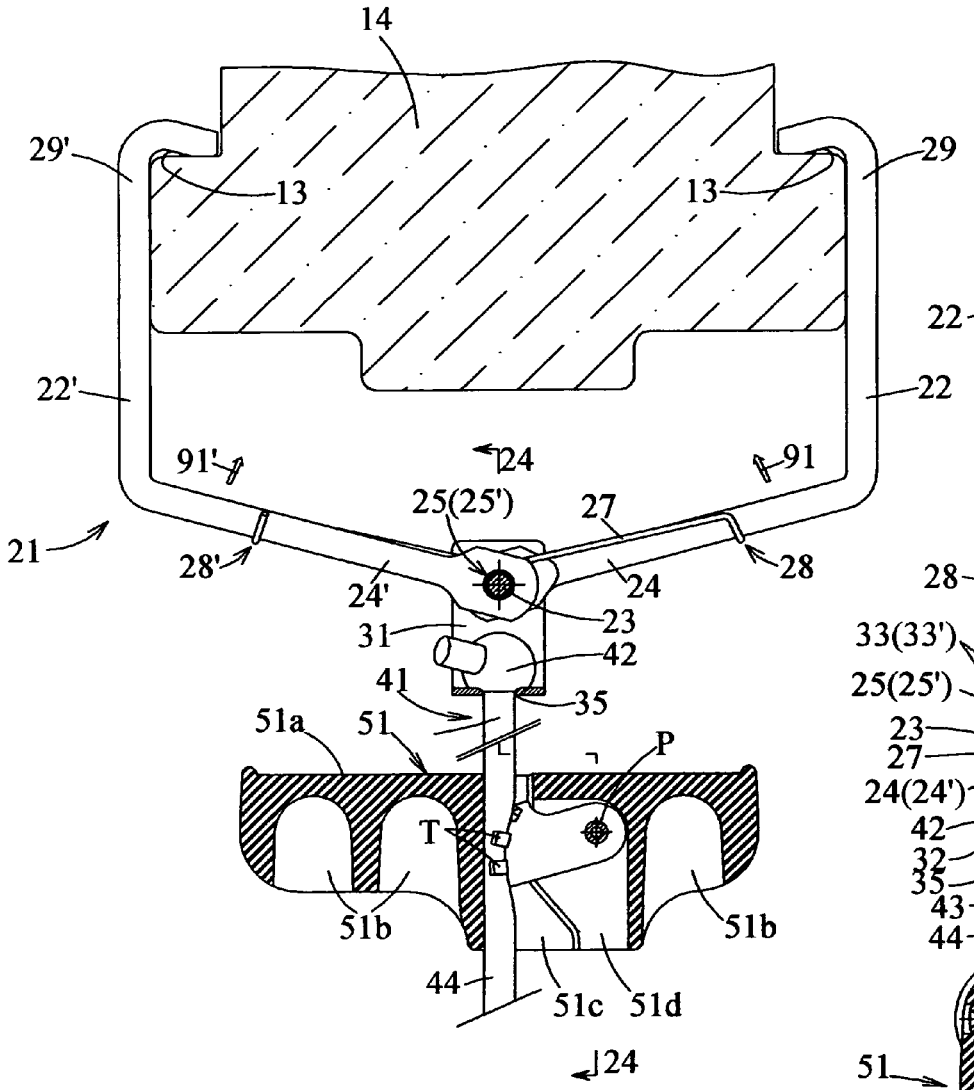
FIG. 23 is similar to FIG. 2*a* but illustrating a presently preferred handle locking mechanism including a cam within the handle.
Figure 24:
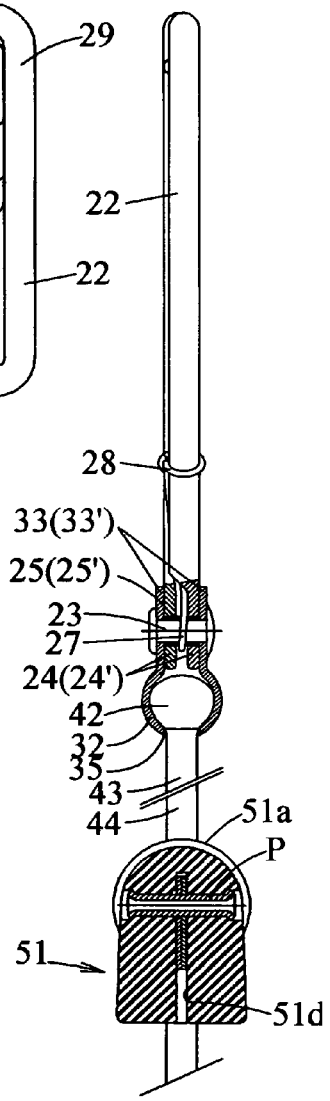
FIG. 24 is similar to FIG. 2*b* but showing the handle locking mechanism of FIG. 23.

Referring to FIGS. 23 and 24 a presently preferred embodiment of a handle locking or adjusting mechanism is shown in which the handles 51 have a generally straight horizontal upper edge 51*a* which may, as best shown in FIG. 24, be arcuate along its horizontal dimension as shown to make the handle more ergonomic and comfortable to hold. The handles 51 may have cavities 51*b* below the upper edge 51*a* to save material and make the device lighter for portability. One of the cavities proximate the line 44 is formed of two stepped regions—a wider region 51*c* and a more narrow region 51*d* to securely accommodate a cam C for free rotation about a pin P. The cam construction is fully described in U.S. patent application Ser. No. 12/927,617, filed on Nov. 19, 2010, the contents of which is incorporated as if fully set forth herein. When in the position shown in FIG. 23 the cam C is in the line or rope locking position and application of downward forces on the handle serves to enhance and maintain the locking relationship to thereby insure that there is no slipping of the line through the handle no matter how high the forces applied to the handles.

Figure 25:
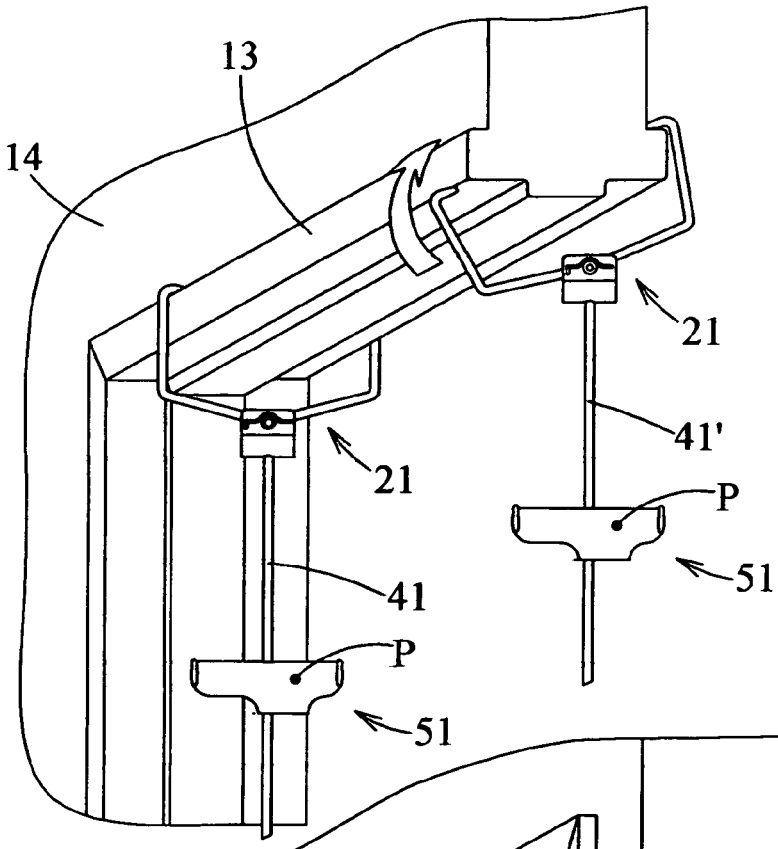
FIG. 25 is a perspective view of a door frame supporting the gymnastic device of FIGS. 23 and 24, showing the orientations of the handles during use when the cams within the handles lock the lines in relations to the handles.
Figure 26:
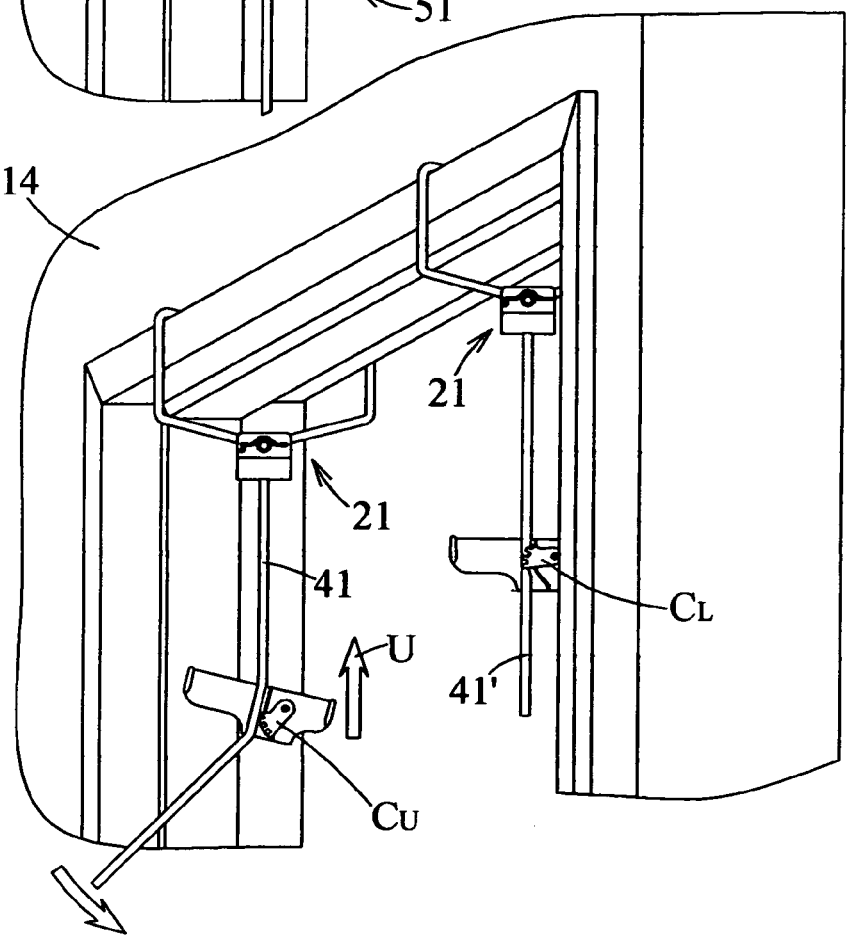
FIG. 26 is similar to FIG. 25 but showing the manner in which the handles are adjusted in height in relation to the supporting lines or ropes.

In FIG. 25 the handle construction shown in FIG. 24 is used on devices attached to a door frame 13. Both handles 51 are in desired positions and in horizontal orientations and ready for use. To adjust the height of a handle in relation to the line the handle may be upwardly in relation to the line as suggested by arrow U and the line deflected to disengage the line from the cam C allow the handle to move up or down along the line without contacting or engaging the cam. Thus, cam $C_u$ is in the unlock position while the cam $C_L$ is shown in the lock position. A full discussion of the cam C construction including the teeth or pressure pads T is contained in the aforementioned application Ser. No. 12/927,617.

While the invention has been described with reference to illustrative embodiments, it is not intended that the novel device be limited thereby, but that modifications thereof are intended to be included within the broad spirit and scope of the disclosure and the following claims to the appended drawings.

The invention claimed is:

1. A portable gymnastic device comprising:

a suspension means having two opposed and complementary rigid hooks, which are pivotally connected together at lower ends of said hooks by a pin which goes through holes into said lower ends and which are engageable over a casing or a horizontal bar by hooked upper ends of said hooks;

a spring connected with said hooks in an area of said lower ends for biasing said hooks to a closed position;

a U-shaped frame having two flat substantially parallel members with opposing holes and a lower bridging or connecting member extending between said parallel members with a generally central hole in its middle part, wherein said lower ends of said hooks are placed between said flat substantially parallel members of said U-shaped frame and are connected with said U-shaped frame by said pin which extends through said opposing holes into said flat substantially parallel members and into said lower ends of said hooks;

a rope having a top knot in a top end of said rope which extends through said generally central hole into said lower bridging or connecting member of said U-shaped frame and said top knot is placed inside of said lower bridging or connecting member;

at least one handle connected to a lower end of said rope; and a connector for securing said rope to said at least one handle.

2. A portable gymnastic device as defined in claim 1, wherein said spring is a torsion spring.

3. A portable gymnastic device as defined in claim 1, wherein said lower ends of said hooks have a flat-shaped portion containing said holes.

4. A portable gymnastic device as defined in claim 1, wherein said hooked upper ends of said hooks are banded.

5. A portable gymnastic device as defined in claim 1, wherein said at least one handle comprises one handle with a hole.

6. A portable gymnastic device as defined in claim 1, wherein said at least one handle comprises more than one handle with a hole.

7. A portable gymnastic device as defined in claim 1, wherein said at least one handle comprises a handle-ladder comprising handles connected together by slats.

8. A portable gymnastic device as defined in claim 1, wherein said connector comprises a knot tied at the lower end of said rope and under said at least one handle.

9. A portable gymnastic device as defined in claim 1, wherein said connector comprises a clamping member for clamping a portion of said rope at a desired position on said rope and a hole in said at least one handle is configured and dimensioned to receive said clamping member in press fit relationship.

10. A portable gymnastic device as defined in claim 9, wherein said clamping member comprises a cam including fingers or pressure pads for contacting said rope in a locking condition.

11. A portable gymnastic device as defined in claim 1, wherein said lower bridging or connecting member is cylindrical.

12. A portable gymnastic device as defined in claim 1, wherein said at least one handle is provided with a hole for passage of said rope.

13. A portable gymnastic device comprising:

a suspension means having two opposed and complementary rigid hooks, which are pivotally connected together at lower ends of said hooks by a pin which goes through holes into said lower ends and which are engageable over a casing or a horizontal bar by hooked upper ends of said hooks;

a U-shaped frame having two flat members with opposing holes and a cylindrical member having an opening in a middle part;

wherein said lower ends of said hooks are located between said flat members of said U-shaped frame and are connected with said U-shaped frame by said pin which goes through said opposing holes into said flat members and into said lower ends of said hooks;

a rope having a top knot in a top end of said rope which goes through said opening into said cylindrical member of said U-shaped frame and said top knot is placed inside of said cylindrical member;

at least one handle connected with said rope and having a hole for the passage of said rope; and a torsion spring extending between said flat members of said U-shaped frame and arranged in a substantially horizontal plane when in a relaxed condition and biasing said hooks to move towards each other when moved to substantially extreme separated or extended positions.

* * * * *